US010974380B1

(12) United States Patent
Diaz

(10) Patent No.: US 10,974,380 B1
(45) Date of Patent: Apr. 13, 2021

(54) MULTI-TOOL WRENCH

(71) Applicant: Luis Diaz, Chesapeake, VA (US)

(72) Inventor: Luis Diaz, Chesapeake, VA (US)

( * ) Notice: Subject to any disclaimer, the term of this patent is extended or adjusted under 35 U.S.C. 154(b) by 333 days.

(21) Appl. No.: 16/188,519

(22) Filed: Nov. 13, 2018

(51) Int. Cl.

| | |
|---|---|
| ***B25F 1/00*** | (2006.01) |
| ***B25F 1/04*** | (2006.01) |
| ***B25B 13/48*** | (2006.01) |
| ***B25G 1/04*** | (2006.01) |
| ***B25B 15/00*** | (2006.01) |
| ***B25B 13/50*** | (2006.01) |

(52) U.S. Cl.
CPC ..... *B25F 1/003* (2013.01); *B25B 13/481* (2013.01); *B25B 13/5058* (2013.01); *B25B 15/005* (2013.01); *B25B 15/007* (2013.01); *B25B 15/008* (2013.01); *B25F 1/04* (2013.01); *B25G 1/043* (2013.01)

(58) Field of Classification Search
CPC . B25F 1/003; B25F 1/04; B25B 13/48; B25B 13/481; B25B 13/5058; B25B 15/005; B25B 15/007; B25B 15/008; B25G 1/043
See application file for complete search history.

(56) References Cited

U.S. PATENT DOCUMENTS

| | | | | |
|---|---|---|---|---|
| 1,522,695 | A * | 1/1925 | Noreen | B25F 1/003 7/127 |
| 5,280,659 | A | 1/1994 | Park | |
| 5,432,968 | A * | 7/1995 | Beck | B25F 1/003 7/127 |
| 6,016,728 | A | 1/2000 | Bohl | |
| 6,119,561 | A * | 9/2000 | Anderson | B25G 1/085 81/440 |
| 6,523,440 | B2 * | 2/2003 | Friedman | B25B 13/04 81/119 |
| 6,643,877 | B1 * | 11/2003 | Amtenbrink | B25B 23/0035 7/125 |
| 7,114,824 | B2 | 10/2006 | Picone | |
| 7,997,170 | B1 * | 8/2011 | Martinez | B25F 1/04 81/427.5 |
| D684,446 | S | 6/2013 | Nichols | |
| 9,138,882 | B2 | 9/2015 | Martin, Sr. | |
| 9,216,503 | B2 | 12/2015 | Lawrence | |
| 10,220,502 | B2 * | 3/2019 | Bradley | B25G 1/085 |
| 10,478,949 | B2 * | 11/2019 | White, II | B25B 13/08 |
| 2011/0303052 | A1 | 12/2011 | Chen | |
| 2016/0001434 | A1 * | 1/2016 | Kania | B25F 1/006 7/139 |
| 2018/0281166 | A1 * | 10/2018 | Chmelar | B25B 13/06 |

* cited by examiner

*Primary Examiner* — David B. Thomas
(74) *Attorney, Agent, or Firm* — Kyle A. Fletcher, Esq.

(57) ABSTRACT

The multi-tool wrench is a single tool that provides multiple tools useful by a craftsman. The multi-tool wrench comprises a first tool half and a second tool half that are removably coupled by a quick disconnect. The halves may be decoupled for use in confined spaces or to simultaneously use tools from each half. The first tool half provides an adjustable wrench and two pivoting hex keys. The adjustable wrench has a reversible lower jaw to convert the wrench into a pipe wrench. The second tool half provides a set of three open end wrenches, a pivoting flat blade screwdriver, and a pivoting cross head screwdriver. The open end wrenches and hex keys may be sized to provide common tools needed in a specific occupation or field. As a non-limiting example, the tools may be common sizes used by a welder.

20 Claims, 5 Drawing Sheets

MULTI-TOOL WRENCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hand tools, more specifically, a multi-tool wrench.

SUMMARY OF INVENTION

The multi-tool wrench is a single tool that provides multiple tools useful by a craftsman. The multi-tool wrench comprises a first tool half and a second tool half that are removably coupled by a quick disconnect. The halves may be decoupled for use in confined spaces or to simultaneously use tools from each half. The first tool half provides an adjustable wrench and two pivoting hex keys. The adjustable wrench has a reversible lower jaw to convert the wrench into a pipe wrench. The second tool half provides a set of three open end wrenches, a pivoting flat blade screwdriver, and a pivoting cross head screwdriver. The open end wrenches and hex keys may be sized to provide common tools needed in a specific occupation or field. As a non-limiting example, the tools may be common sizes used by a welder.

An object of the invention is to provide a single tool that provides an adjustable wrench, three open end wrenches, two hex keys, a flat blade screwdriver, and a cross head screwdriver.

Another object of the invention is to provide a reversible lower jaw for the adjustable wrench such that the adjustable wrench can be converted into a pipe wrench.

A further object of the invention is to provide a pivoting coupling between the multi-tool and the hex keys and screwdrivers.

Yet another object of the invention is to provide the tool in two halves with a quick disconnect between them.

These together with additional objects, features and advantages of the multi-tool wrench will be readily apparent to those of ordinary skill in the art upon reading the following detailed description of the presently preferred, but nonetheless illustrative, embodiments when taken in conjunction with the accompanying drawings.

In this respect, before explaining the current embodiments of the multi-tool wrench in detail, it is to be understood that the multi-tool wrench is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-tool wrench.

It is therefore important that the claims be regarded as including such equivalent construction insofar as they do not depart from the spirit and scope of the multi-tool wrench. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
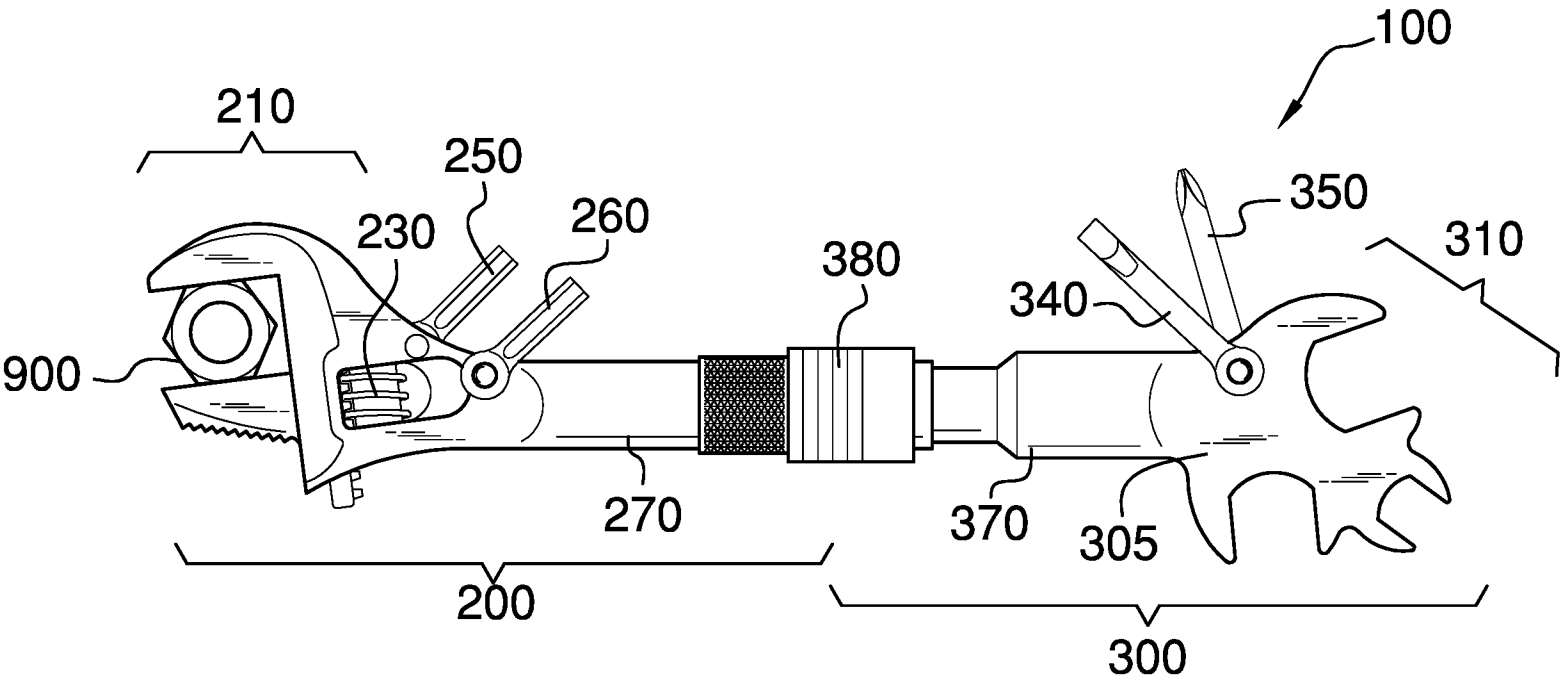
FIG. 1 is a front view of an embodiment of the disclosure.
Figure 2:
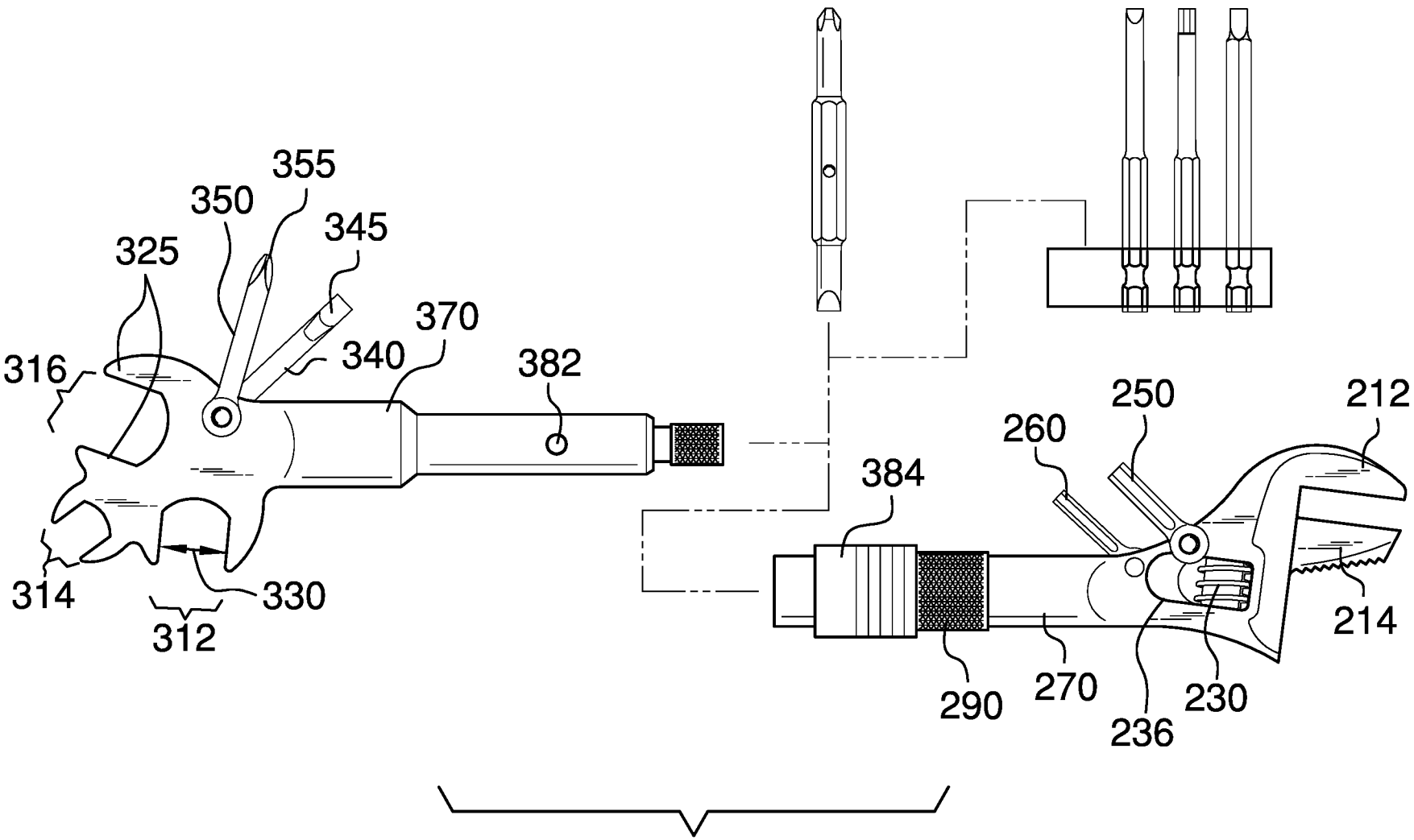
FIG. 2 is a rear view of an embodiment of the disclosure illustrating the two tool halves decoupled.
Figure 4:
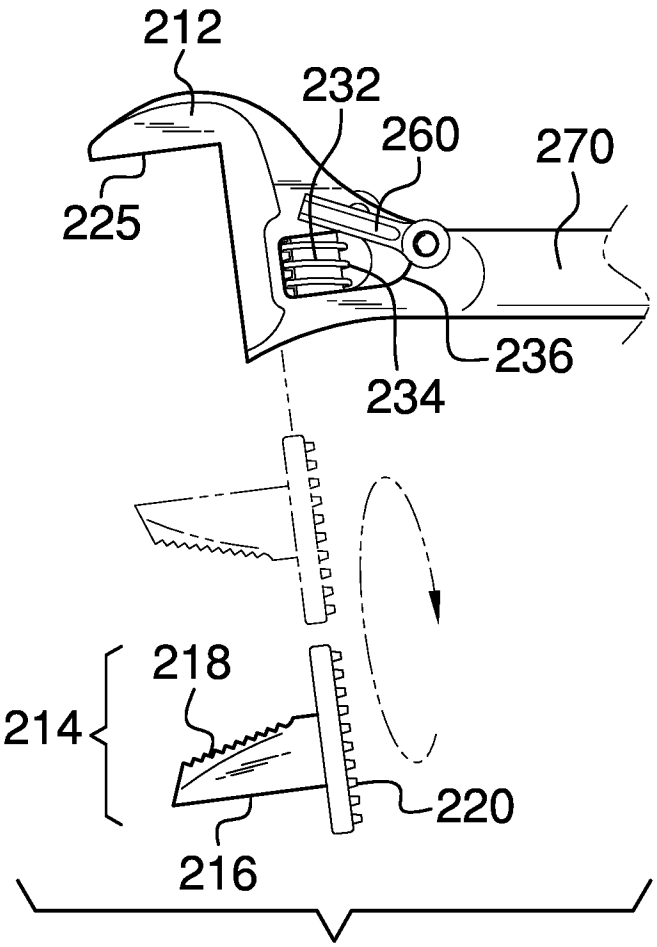
FIG. 4 is a detail view of an embodiment of the disclosure illustrating the reversible lower jaw.
Figure 3:
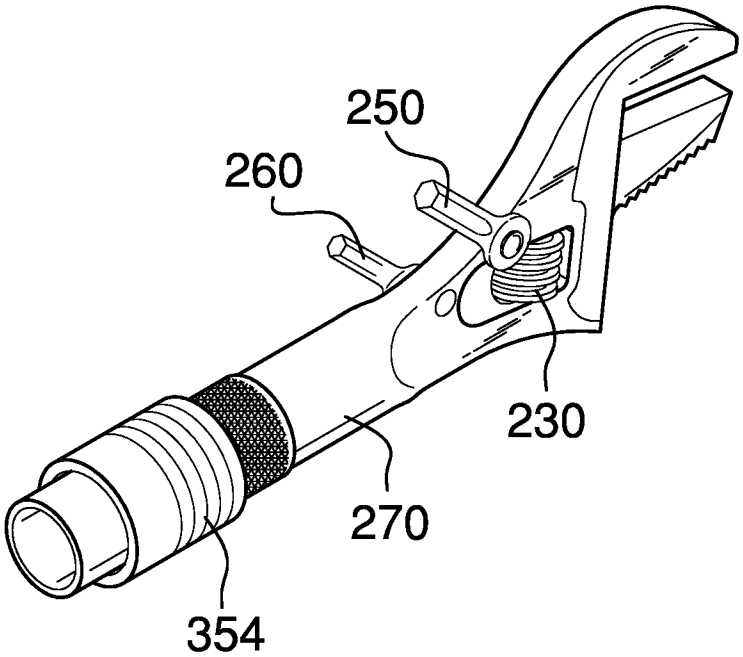
FIG. 3 is a detail view of an embodiment of the disclosure illustrating the first tool half.
Figure 5:
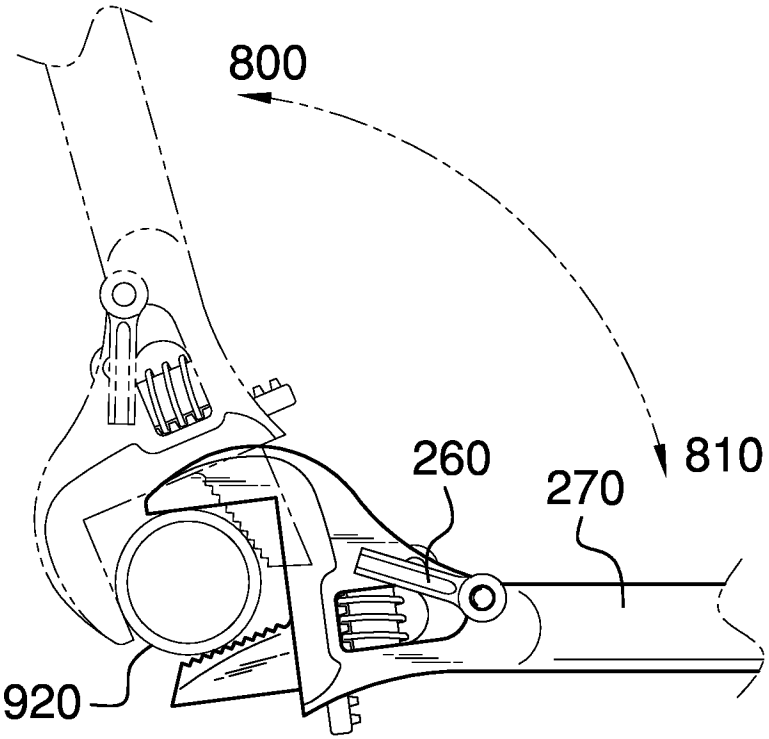
FIG. 5 is a detail view of an embodiment of the disclosure illustrating use of the pipe wrench.
Figure 6:
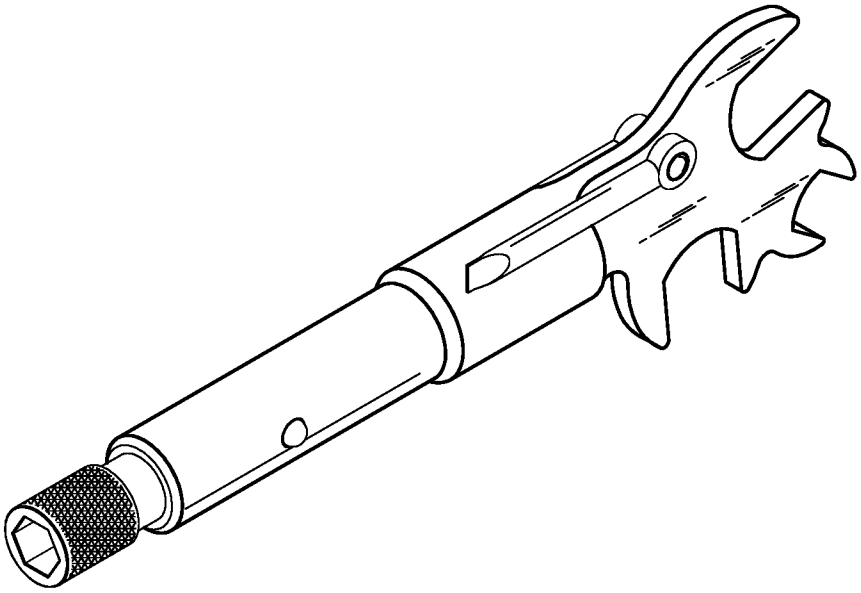
FIG. 6 is a detail view of an embodiment of the disclosure illustrating the second tool half.

Detailed reference will now be made to a first potential embodiment of the disclosure, which is illustrated in FIGS. 1 through 6.

The multi-tool wrench 100 (hereinafter invention) comprises a first tool half 200, a second tool half 300, and a quick disconnect 380. The invention 100 provides multiple tools in a single apparatus. The first tool half 200 separates from the second tool half 300 at the quick disconnect 380 so that an adjustable wrench 210 on the first tool half 200 may be used simultaneously with a plurality of fixed wrenches 310 on the second tool half 300 or to shorten the tool for use in confined spaces.

The first tool half 200 comprises the adjustable wrench 210, a first hex key 250, a second hex key 260, and a first handle 270. The adjustable wrench 210 may be a resizable wrench that may be used to loosen or tighten a nut, bolt, or fitting 900. The first hex key 250 and the second hex key 260 may be two different sizes of hex keys that may be used to loosen or tighten a screw or bolt having a hexagonal socket in the head of the screw or bolt.

The adjustable wrench 210 comprises an upper jaw 212, a lower jaw 214, and a worm screw 230. The upper jaw 212 is fixed relative to the rest of the invention 100 and provides an upper flat surface 225 that presses against one side of the nut, bolt, or fitting 900. The lower jaw 214 may be adjusted to press a lower flat surface 216 against the opposing side of the nut, bolt, or fitting 900. With the upper jaw 212 and the lower jaw 214 in position adjacent to opposing sides of the nut, bolt, or fitting 900, a twisting motion of the first handle 270 around the center of the nut, bolt, or fitting 900 may cause rotational motion of the nut, bolt, or fitting 900. Twisting in a first rotational direction 800 may cause the nut, bolt, or fitting 900 to loosen. Twisting in a second rotational direction 810 may cause the nut, bolt, or fitting 900 to tighten.

The lower jaw 214 comprises the lower flat surface 216, a toothed surface 218, and a toothed shaft 220. The lower jaw 214 may be removed from the adjustable wrench 210, reversed 180 degrees in a longitudinal direction, and reinserted into the adjustable wrench 210 to convert the adjustable wrench 210 into a pipe wrench. With the lower jaw 214 reversed, the toothed surface 218 replaces the lower flat surface 216 in opposition to the flat edge of the upper jaw 212. With the lower jaw 214 reversed, the upper flat surface 225 may be placed on one side of a pipe 920, the lower jaw 214 may be adjusted to press the toothed surface 218 against the opposing side of the pipe 920, and a twisting motion of the adjustable wrench 210 may cause the toothed surface 218 to grasp and rotate the pipe 920.

The lower jaw 214 may be adjusted by action of the toothed shaft 220 being moved longitudinally by the worm screw 230. Rotation of the worm screw 230 may push the toothed shaft 220 up or down. Continued rotation of the worm screw 230 in one direction may cause the toothed shaft 220 to move down until the lower jaw 214 detaches from the adjustable wrench 210 at which point the lower jaw 214 may be reversed. Continued rotation of the worm screw 230 in the opposite direction may cause the toothed shaft 220 to move up until the upper flat surface 225 or the toothed surface 218 presses against the upper flat surface 225.

The worm screw 230 comprises a central shaft 232 and a helical gear tooth 234. The worm screw 230 may be pivotably coupled to the upper jaw 212 such that the worm screw 230 is free to rotate around the central shaft 232 within a cavity 236 in the upper jaw 212. The worm screw 230 may be oriented with its axis of rotation perpendicular to the upper flat surface 225 and within the plane of the adjustable wrench 210. The helical gear tooth 234 may engage the toothed shaft 220 on the lower jaw such that as the worm screw 230 rotates around the central shaft 232, the helical gear tooth 234 pushes the lower jaw 214 up or down.

The first hex key 250 and the second hex key 260 may be pivotably coupled to the first tool half 200 of the invention 100 on opposing sides of the first tool half 200. The first hex key 250 and the second hex key 260 may pivot such that they are parallel and adjacent to the first handle 270 when not in use. The first hex key 250 and the second hex key 260 may independently pivot away from the first handle 270 when needed to present a shaft having a hexagonal cross-section.

The first handle 270 may be a handgrip for the first tool half 200. The first handle 270 may couple to a second handle 370 to join the first tool half 200 to the second tool half 300, forming a single tool.

The second tool half 300 comprises the plurality of fixed wrenches 310, a flat blade screwdriver 340, a cross head screwdriver 350, and the second handle 370. The plurality of fixed wrenches 310 may be a set of three fixed wrenches that are stamped, molded, cut, or otherwise formed in a metal armature 305. The metal armature 305 may be coupled to the second handle 370. The second handle 370 may be a handgrip for the second tool half 300.

The plurality of fixed wrenches 310 comprises a first fixed wrench 312, a second fixed wrench 314, and a third fixed wrench 316. Each of the plurality of fixed wrenches 310 may comprise an open end wrench bounded on opposing sides of the open end wrench by flats 325 that are parallel to each other. A wrench width 330 between the flats 325 defines the size of the nut, bolt, or fitting 900 that each of the open end wrenches is intended to loosen or tighten.

The first fixed wrench 312 may be oriented such that the first fixed wrench 312 opens in a direction that is perpendicular to the second handle 370. The second fixed wrench 314 may be oriented such that the second fixed wrench 314 opens in a direction that is oblique to the direction that the first fixed wrench 312 opens. The wrench width 330 of the second fixed wrench 314 may be different from the wrench width 330 of the first fixed wrench 312. The third fixed wrench 316 may be oriented such that the third fixed wrench 316 opens in a direction that is oblique to the direction that the second fixed wrench 314 opens. The wrench width 330 of the third fixed wrench 316 may be different from the wrench width 330 of the first fixed wrench 312. The wrench width 330 of the third fixed wrench 316 may be different from the wrench width 330 of the second fixed wrench 314. As used herein, the direction that the open end wrench opens is defined by its centerline and the centerline of the open end wrench is defined to be a line drawn equidistant from and parallel to the flats 325 of the open end wrench.

The flat blade screwdriver 340 may be a shaft pivotably coupled to the second handle 370 at one end and terminating with a flat screwdriver blade 345 at the other end. The flat blade screwdriver 340 may pivot such that the flat blade screwdriver 340 is parallel and adjacent to the second handle 370 when not in use. The flat blade screwdriver 340 may pivot away from the second handle 370 for use.

The cross head screwdriver 350 may be a shaft pivotably coupled to the second handle 370 at one end and terminating with a cross head blade 355, also known as a Phillips head blade, at the other end. The cross head screwdriver 350 may pivot such that the cross head screwdriver 350 is parallel and adjacent to the second handle 370 when not in use. The cross head screwdriver 350 may pivot away from the second handle 370 for use.

The quick disconnect 380 may couple the first tool half 200 to the second tool half 300 to form a single tool. The quick disconnect 380 may release the first tool half 200 from the second tool half 300 without requiring the use of a tool to decouple the first tool half 200 and the second tool half 300. As a non-limiting example, the quick disconnects 380 may comprise a slotted ring 384 on the first handle 270 and a tab 382 on the second handle 370 such that the second handle 370 may slide into the first handle 270 and may be held in that position by the slotted ring 384 engaging with the tab 382.

The second handle 370 of the second tool half 300 may feature a fixed ratchet member 777. The fixed ratchet member 777 enables socket bit tools 778 to connect thereon. The socket bit tools 778 typically involve a plurality of different screwdriver bits, which are well known in the art of hand tools. When not in use, the fixed ratchet member 777 slides into the quick disconnect 380 of the first tool half 200 (see FIGS. 1-2).

In some embodiments, the dimensions of the first hex key 250, the second hex key 260, the first fixed wrench 312, the second fixed wrench 314, and the third fixed wrench 316 may be selected to match commonly used tools for a particular field or industry. As a non-limiting example, the dimensions of the first hex key 250, the second hex key 260, the first fixed wrench 312, the second fixed wrench 314, and the third fixed wrench 316 may be selected to match the sizes of fittings and components frequently used in the welding industry, such as electrode holders, flow meters, gas line fittings, and torches. As a non-limiting example, the first hex key 250 and the second hex key 260 may be 7/32 inch and ¼ inch hex keys and the first fixed wrench 312, the second fixed wrench 314, and the third fixed wrench 316 may be 11/16 inch, 7/16 inch, and ¾ inch wrenches.

The first handle 270, the second handle 370, or both may be covered by a nonslip covering 290 to provide more friction while being held. As non-limiting examples, the nonslip covering 290 may be an etched, engraved, or stamped finished or a coating applied to the first handle 270 and/or the second handle 370.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, a "cavity" is an empty space or negative space that is formed within an object.

As used in this disclosure, the "centerline" is an imaginary line that defines the center of multiple cross sections of an object. Unless stated otherwise, the centerline follows a longitudinal path through the object at the center of lateral cross sections. If the object is tubular, the centerline follows the center of the tube.

As used in this disclosure, a "coating" refers to a substance that is applied to the exterior surface of an object such that the coating forms a new exterior surface of the object. A coating is commonly said to be formed as a layer. As a non-limiting example, paint is a common coating material.

As used herein, the words "couple", "couples", "coupled" or "coupling", refer to connecting, either directly or indirectly, and does not necessarily imply a mechanical connection.

As used in this disclosure, a "cross-section" is a surface or shape that would be exposed by making a straight cut through an object.

As used in this disclosure, a "gear" is a toothed wheel, cylinder, or other toothed mechanical element that is used to transmit motion, a change of speed, or a change of direction to second toothed wheel, cylinder, rack, or other toothed or slotted mechanical element.

As used in this disclosure, a "handle" is an object by which a tool, object, or door is held or manipulated with the hand.

As used in this disclosure, a "helix" is the three dimensional structure that is formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute. "Helical" is an adjective which indicates that an object is shaped like a helix.

As used herein, the word "longitudinal" or "longitudinally" refers to a lengthwise or longest direction.

As used in this disclosure, a "pipe" is a hollow cylindrical device that is used for transporting liquids and gases or for structural purposes. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, the term "shaft" is used to describe a rigid cylinder that is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "socket" is an opening or cavity that is configured to receive an inserted component.

As used in this disclosure, a "tab" is an extension of an object for the purpose of facilitating the manipulation of the object, identifying the object, or attaching the object to another object.

As used in this disclosure, a "tool" is a device, an apparatus, or an instrument that is used to carry out an activity, operation, or procedure.

As used herein, "worm screw" refers to a cylindrical shaft having a helical protrusion or groove. The worm screw is intended to engage a complimentary feature on a gear or rack such that rotational motion of the worm screw results in rotation of the gear around an axis perpendicular to the axis of the worm screw or in linear motion of the rack.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-tool wrench comprising:

a first tool half, a second tool half, and a quick disconnect;

wherein the multi-tool wrench provides multiple tools in a single apparatus;

wherein the first tool half separates from the second tool half at the quick disconnect so that an adjustable wrench on the first tool half is usable simultaneously with a plurality of fixed wrenches on the second tool half or to shorten the tool for use in confined spaces.

2. The multi-tool wrench according to claim 1 wherein the first tool half comprises the adjustable wrench, a first hex key, a second hex key, and a first handle;

wherein the adjustable wrench is a resizable wrench that is used to loosen or tighten a nut, bolt, or fitting;

wherein the first hex key and the second hex key are two different sizes of hex keys that are used to loosen or tighten a screw or bolt having a hexagonal socket in the head of the screw or bolt.

3. The multi-tool wrench according to claim 2 wherein the adjustable wrench comprises an upper jaw, a lower jaw, and a worm screw;

wherein the upper jaw is fixed relative to the rest of the multi-tool wrench and provides an upper flat surface that presses against one side of the nut, bolt, or fitting;

wherein the lower jaw is adjusted to press a lower flat surface against the opposing side of the nut, bolt, or fitting;

wherein with the upper jaw and the lower jaw in position adjacent to opposing sides of the nut, bolt, or fitting, a twisting motion of the first handle around the center of the nut, bolt, or fitting causes rotational motion of the nut, bolt, or fitting;

wherein twisting in a first rotational direction causes the nut, bolt, or fitting to loosen;

wherein twisting in a second rotational direction causes the nut, bolt, or fitting to tighten.

4. The multi-tool wrench according to claim 3 wherein the lower jaw comprises the lower flat surface, a toothed surface, and a toothed shaft;

wherein the lower jaw is removed from the adjustable wrench, reversed 180 degrees in a longitudinal direction, and reinserted into the adjustable wrench to convert the adjustable wrench into a pipe wrench;

wherein with the lower jaw reversed, the toothed surface replaces the lower flat surface in opposition to the flat edge of the upper jaw;

wherein with the lower jaw reversed, the upper flat surface is placed on one side of a pipe, the lower jaw is adjusted to press the toothed surface against the opposing side of the pipe, and a twisting motion of the adjustable wrench cause the toothed surface to grasp and rotate the pipe.

5. The multi-tool wrench according to claim 4 wherein the lower jaw is adjusted by action of the toothed shaft being moved longitudinally by the worm screw;

wherein rotation of the worm screw pushes the toothed shaft up or down;

wherein continued rotation of the worm screw in one direction causes the toothed shaft to move down until the lower jaw detaches from the adjustable wrench;

wherein continued rotation of the worm screw in the opposite direction causes the toothed shaft to move up until the upper flat surface or the toothed surface presses against the upper flat surface.

6. The multi-tool wrench according to claim 5 wherein the worm screw comprises a central shaft and a helical gear tooth;

wherein the worm screw is pivotably coupled to the upper jaw such that the worm screw is free to rotate around the central shaft within a cavity in the upper jaw;

wherein the worm screw is oriented with its axis of rotation perpendicular to the upper flat surface and within the plane of the adjustable wrench;

wherein the helical gear tooth engages the toothed shaft on the lower jaw such that as the worm screw rotates around the central shaft, the helical gear tooth pushes the lower jaw up or down.

7. The multi-tool wrench according to claim 6 wherein the first hex key and the second hex key are pivotably coupled to the first tool half of the multi-tool wrench on opposing sides of the first tool half;

wherein the first hex key and the second hex key pivot such that they are parallel and adjacent to the first handle when not in use;

wherein the first hex key and the second hex key independently pivot away from the first handle when needed to present a shaft having a hexagonal cross-section.

8. The multi-tool wrench according to claim 7 wherein the first handle is a handgrip for the first tool half;

wherein the first handle couples to a second handle to join the first tool half to the second tool half, forming a single tool.

9. The multi-tool wrench according to claim 8 wherein the second tool half comprises the plurality of fixed wrenches, a flat blade screwdriver, a cross head screwdriver, and the second handle;

wherein the plurality of fixed wrenches are a set of three fixed wrenches that are stamped, molded, cut, or otherwise formed in a metal armature;

wherein the metal armature is coupled to the second handle;

wherein the second handle is a handgrip for the second tool half.

10. The multi-tool wrench according to claim 9 wherein the plurality of fixed wrenches comprises a first fixed wrench, a second fixed wrench, and a third fixed wrench;

wherein each of the plurality of fixed wrenches comprise an open end wrench bounded on opposing sides of the open end wrench by flats that are parallel to each other;

wherein a wrench width between the flats defines the size of the nut, bolt, or fitting that each of the open end wrenches is intended to loosen or tighten.

11. The multi-tool wrench according to claim 10 wherein the first fixed wrench is oriented such that the first fixed wrench opens in a direction that is perpendicular to the second handle;

wherein the second fixed wrench is oriented such that the second fixed wrench opens in a direction that is oblique to the direction that the first fixed wrench opens;

wherein the wrench width of the second fixed wrench is different from the wrench width of the first fixed wrench;

wherein the third fixed wrench is oriented such that the third fixed wrench opens in a direction that is oblique to the direction that the second fixed wrench opens;

wherein the wrench width of the third fixed wrench is different from the wrench width of the first fixed wrench;

wherein the wrench width of the third fixed wrench is different from the wrench width of the second fixed wrench.

12. The multi-tool wrench according to claim 11 wherein the flat blade screwdriver is a shaft pivotably coupled to the second handle at one end and terminating with a flat screwdriver blade at the other end;

wherein the flat blade screwdriver pivots such that the flat blade screwdriver is parallel and adjacent to the second handle when not in use;

wherein the flat blade screwdriver pivots away from the second handle for use;

wherein the cross head screwdriver is a shaft pivotably coupled to the second handle at one end and terminating with a cross head blade at the other end;

wherein the cross head screwdriver pivots such that the cross head screwdriver is parallel and adjacent to the second handle when not in use;

wherein the cross head screwdriver pivots away from the second handle for use.

13. The multi-tool wrench according to claim 12 wherein the quick disconnect couples the first tool half to the second tool half to form a single tool;

wherein the quick disconnect releases the first tool half from the second tool half without requiring the use of a tool to decouple the first tool half and the second tool half.

14. The multi-tool wrench according to claim 13 wherein the quick disconnects comprises a slotted ring on the first handle and a tab on the second handle such that the second handle slides into the first handle and is held in that position by the slotted ring engaging with the tab.

15. The multi-tool wrench according to claim 13 wherein the dimensions of the first hex key, the second hex key, the first fixed wrench, the second fixed wrench, and the third fixed wrench are selected to match commonly used tools for a particular field or industry.

16. The multi-tool wrench according to claim 15 wherein the dimensions of the first hex key, the second hex key, the first fixed wrench, the second fixed wrench, and the third fixed wrench are selected to match the sizes of fittings and components frequently used in the welding industry, such as electrode holders, flow meters, gas line fittings, and torches.

17. The multi-tool wrench according to claim 16 wherein the first hex key and the second hex key are 11 7/32 inch and 1/4 inch hex keys and the first fixed wrench, the second fixed wrench, and the third fixed wrench are 11/16 inch, 7/16 inch, and 3/4 inch wrenches.

18. The multi-tool wrench according to claim 13 wherein the first handle, the first handle, or both are covered by a nonslip covering to provide more friction while being held.

19. The multi-tool wrench according to claim 18 wherein the nonslip covering is an etched, engraved, or stamped finished or a coating applied to the first handle and/or the second handle.

20. The multi-tool wrench according to claim 13 wherein the second handle of the second tool half includes a fixed ratchet member;

wherein the fixed ratchet member enables socket bit tools to connect thereon.

* * * * *